US010212974B1

(12) United States Patent
Joshi

(10) Patent No.: US 10,212,974 B1
(45) Date of Patent: Feb. 26, 2019

(54) GARMENT FOR PROTECTING THE HUMAN BODY

(71) Applicant: Cyrus K. Joshi, Louisville, KY (US)

(72) Inventor: Cyrus K. Joshi, Louisville, KY (US)

( * ) Notice: Subject to any disclaimer, the term of this patent is extended or adjusted under 35 U.S.C. 154(b) by 441 days.

(21) Appl. No.: 14/946,427

(22) Filed: Nov. 19, 2015

(51) Int. Cl.
*A41D 13/05* (2006.01)

(52) U.S. Cl.
CPC ..... *A41D 13/0506* (2013.01); *A41D 13/0537* (2013.01); *A41D 13/0562* (2013.01); *A41D 13/0568* (2013.01)

(58) Field of Classification Search
CPC ..... A41D 13/0506; A41D 13/0537; A41D 13/0562; A41D 13/0568
See application file for complete search history.

(56) References Cited

U.S. PATENT DOCUMENTS 1,088,273 A * 2/1914 Golden ..... A63B 71/1225 2/22
1,128,122 A * 2/1915 Fox ..... A63B 71/1225 2/22
1,310,958 A * 7/1919 O'Connor ..... B60R 22/105 128/875
1,335,927 A * 4/1920 Ainsworth ..... A41F 3/00 2/300
2,266,886 A * 12/1941 McCoy ..... A41D 13/015 2/16
2,889,830 A * 6/1959 Raymond ..... A41D 13/0506 2/22
3,579,639 A * 5/1971 Faulkner ..... A41F 3/02 2/117
4,512,437 A * 4/1985 Savage ..... A62B 35/0018 119/857
4,870,706 A 10/1989 Ketcham et al.
5,133,092 A * 7/1992 Altinger ..... A62B 17/001 2/300
D342,348 S * 12/1993 Panarelli ..... D29/101.1
5,319,806 A * 6/1994 Hermann ..... A41D 13/0512 2/267
5,500,952 A 3/1996 Keyes
5,545,128 A 8/1996 Hayes et al.
5,584,072 A * 12/1996 Kim ..... A41D 13/0506 2/22
5,814,001 A * 9/1998 Schwenn ..... A61F 5/0193 602/23

(Continued)

FOREIGN PATENT DOCUMENTS

CA 2643985 3/2010
JP 2013231248 11/2013
WO 2014153300 9/2014

OTHER PUBLICATIONS

Siler, Wes, Back Protectors for Any Ride, Ride Apart, https://rideapart.com/articles/best-motorcycle-back-protectors, 13 pages. Nov. 8, 2013.

(Continued)

*Primary Examiner* — Richale Quinn
(74) *Attorney, Agent, or Firm* — Middleton Reutlinger

(57) ABSTRACT

Apparatus for protecting against injury to the human body. The garment may protect against hip, tailbone, and/or spinal cord injury. The garment may have a waist belt with depending hip pads releasably secured to the legs. Also, a torso strap may extend upwardly from the waist belt with additional padding. The torso strap may be Y-shaped.

23 Claims, 3 Drawing Sheets

(56) References Cited

U.S. PATENT DOCUMENTS 5,893,367 A * 4/1999 Dubats ..... A61F 5/0193 128/875
5,937,443 A 8/1999 Kageyama et al.
6,131,196 A * 10/2000 Vallion ..... A41D 13/0568 2/24
D435,168 S * 12/2000 Momburg ..... D3/215
6,345,396 B1 * 2/2002 Schuler ..... A41D 13/0537 2/465
6,375,056 B1 * 4/2002 Henri ..... A41D 27/205 224/250
6,752,776 B2 * 6/2004 West ..... A61H 3/008 602/32
6,859,948 B2 3/2005 Melts
D509,627 S * 9/2005 Willows ..... D29/101.2
6,942,630 B2 * 9/2005 Behan ..... A61F 5/0102 128/875
D512,535 S * 12/2005 Willows ..... D29/101.2
7,066,181 B2 * 6/2006 West ..... A61H 3/008 128/869
7,210,605 B2 * 5/2007 Willows ..... A41D 13/01 224/623
7,608,026 B1 * 10/2009 Nicassio ..... A63B 21/00185 24/265 BC
8,151,376 B2 4/2012 Onrot et al.
8,281,418 B2 10/2012 Cohen
8,296,862 B2 10/2012 Sandusky et al.
8,484,766 B2 7/2013 Smith
8,522,369 B2 9/2013 Bay
D784,545 S * 4/2017 Jangir ..... D24/190
2006/0059609 A1 3/2006 Moss
2007/0251965 A1 * 11/2007 Mosley ..... A45F 3/047 224/637
2012/0284908 A1 11/2012 McCredy
2013/0192336 A1 8/2013 O'Connor
2014/0008401 A1 1/2014 Scott
2014/0208490 A1 7/2014 Freixas

OTHER PUBLICATIONS

Secure Male Hip Protector, Walgreens, 3 pages Jun. 12, 2015.
Hipsters: Posey Hipsters EZ-On Brief, AliMed, 3 pages Jun. 12, 2015.

* cited by examiner

GARMENT FOR PROTECTING THE HUMAN BODY

TECHNICAL FIELD

Generally, a garment for protecting the human body is disclosed. More specifically, present embodiments relate to a garment protecting, but is not limited to, the hips, spinal cord, and/or tailbone from injury.

BACKGROUND

Existing garments that protect different areas of the human body typical are not designed for individuals with limited mobility, such as but not limited to elderly individuals. Passing the hands or feet first and subsequently the remainder the arms and legs, respectively, into the garment before pulling into position for example may be difficult. For example, the device may require stepping into the garment, such as but not limited to shorts, and pulling back up to the waist. Thus, there is a need in the art for overcoming the issues of existing devices. The present embodiments may provide these individuals with limited mobility the opportunity to dress oneself with the garment relative to the human body to offer protection from injury.

SUMMARY

In one aspect of the present embodiments, the garment includes a waist belt with a torso strap and depending hip pads. The waist belt, torso strap, and/or hip pads may be releasable secured to the human body. The torso strap may include a first and second back strap extending upwardly from the waist belt and converges to a front strap that is releasably secured to the waist belt. Torso strap defines a slot within the first and second back strap to receive the head of the human body. The slot may assist in positioning the garment relative to the body.

One embodiment of the protective garment for a human body may include a waist belt adapted to releasably secure about the waist. The waist belt may include a front side and a back side. A first hip pad and an opposing second hip pad may depend from the waist belt. Each of the first hip pad and the second hip pad has a first end adjacent the waist belt and an opposing second end spaced away therefrom. Each of the first hip pad and the second hip pad may include one or more padding. The first hip pad may include a first thigh strap adjacent the second end of the first hip pad and adapted to releasably secure above the right knee. The second hip pad may include a second thigh strap adjacent the second end of the second hip pad and adapted to releasably secure above the left knee. Further, the garment may include a torso strap including a first back strap, a second back strap, and a front strap. The front strap may include a first end and a second end. The first back strap and the second back strap may extend upwardly from the back side of the waist belt and converge together at the first end of the front strap to define a slot adapted to receive the neck. The second end of the front strap releasably secures to the front side of the waist belt. Each of the first back strap and the second back strap may include one or more padding. The garment may include a tailbone pad having one or more padding. The one or more padding may be air pockets. Each of the first back strap and the second back strap may be fixedly secured to the back side of the waist belt. The slot may narrow in a direction from the back side of the waist belt to the first end of the front strap. The front strap may include one or more padding.

Another embodiment of the protective garment for a human body may include a waist belt adapted to releasably secure about the waist. The waist belt may include a front side and a back side. A first hip pad and an opposing second hip pad depending from the waist belt. Each one of the first hip pad and the second hip pad has a first end adjacent the waist belt and an opposing second end spaced away therefrom. Each of the first hip pad and the second hip pad includes one or more padding. A tailbone pad may depend from the waist belt between the first hip pad and the second hip pad. The tailbone pad may have one or more padding. The first hip pad may include a first thigh strap adjacent the second end of the first hip pad and adapted to releasably secure above the right knee. The second hip pad may include a second thigh strap adjacent the second end of the second hip pad and adapted to releasably secure above the left knee. Further, the garment may include a torso strap including a first back strap, a second back strap, and a front strap. The front strap may include a first end and a second end. The first back strap and the second back strap may extend upwardly from the back side of the waist belt and converge together at the first end of the front strap to define a slot adapted to receive the neck. The second end of the front strap releasably secures to the front side of the waist belt. Each of the first back strap and the second back strap may include one or more padding. The one or more padding may be air pockets. Each of the first back strap and the second back strap is fixedly secured to the back side of the waist belt. The slot may narrow in a direction from the back side of the waist belt to the first end of the front strap. The front strap may include one or more padding.

Further, another embodiment of a protective garment for the human body may include a waist belt adapted to releasably secure about the waist. The waist belt may include a front side and a back side. A first hip pad and an opposing second hip pad depending from the waist belt. Each one of the first hip pad and the second hip pad has a first end adjacent the waist belt and an opposing second end spaced away therefrom. Each of the first hip pad and the second hip pad may include one or more padding. A tailbone pad may depend from the waist belt between the first hip pad and the second hip pad. The tailbone pad may have one or more padding. The first hip pad may include a first thigh strap adjacent the second end of the first hip pad and adapted to releasably secure above the right knee. The second hip pad may include a second thigh strap adjacent the second end of the second hip pad and adapted to releasably secure above the left knee. Further, the garment may include a torso strap that includes a Y-shaped strap extending from the back side of the waist belt to the front side of the waist belt. The Y-shaped strap may have two back attachments on the back side of the waist belt and a front attachment on the front side of the waist belt. At least the front attachment may releasably secure to the front side of the waist belt. The Y-shaped strap may include one or more padding. The one or more padding may be air pockets. The two back attachments may be fixedly secured to the back side of the waist belt. The Y-shaped strap may include two back straps converging with a front strap. The front attachment may include the front strap looped around the waist belt and secured upon itself, the front strap. The front strap may be secured upon the front strap by a hook and loop fastener. The two back straps may include the one or more padding. The waist belt may include an attachment to releasably secure about the waist. Further, the attachment of the waist belt may be adjacent the front attachment.

It should be appreciated that all combinations of the foregoing concepts and additional concepts discussed in greater detail below provided such concepts are not mutually inconsistent are contemplated as being part of the subject matter disclosed herein. In particular, all combinations of claimed subject matter appearing at the end of this disclosure are contemplated as being part of the subject matter disclosed herein.

BRIEF DESCRIPTION OF THE DRAWINGS

In the drawings, like reference characters generally refer to the same parts throughout the different views. Also, the drawings are not necessarily to scale, and emphasis instead generally placed upon illustrating the principals of the embodiments depicted.

DETAILED DESCRIPTION

Figure 1:
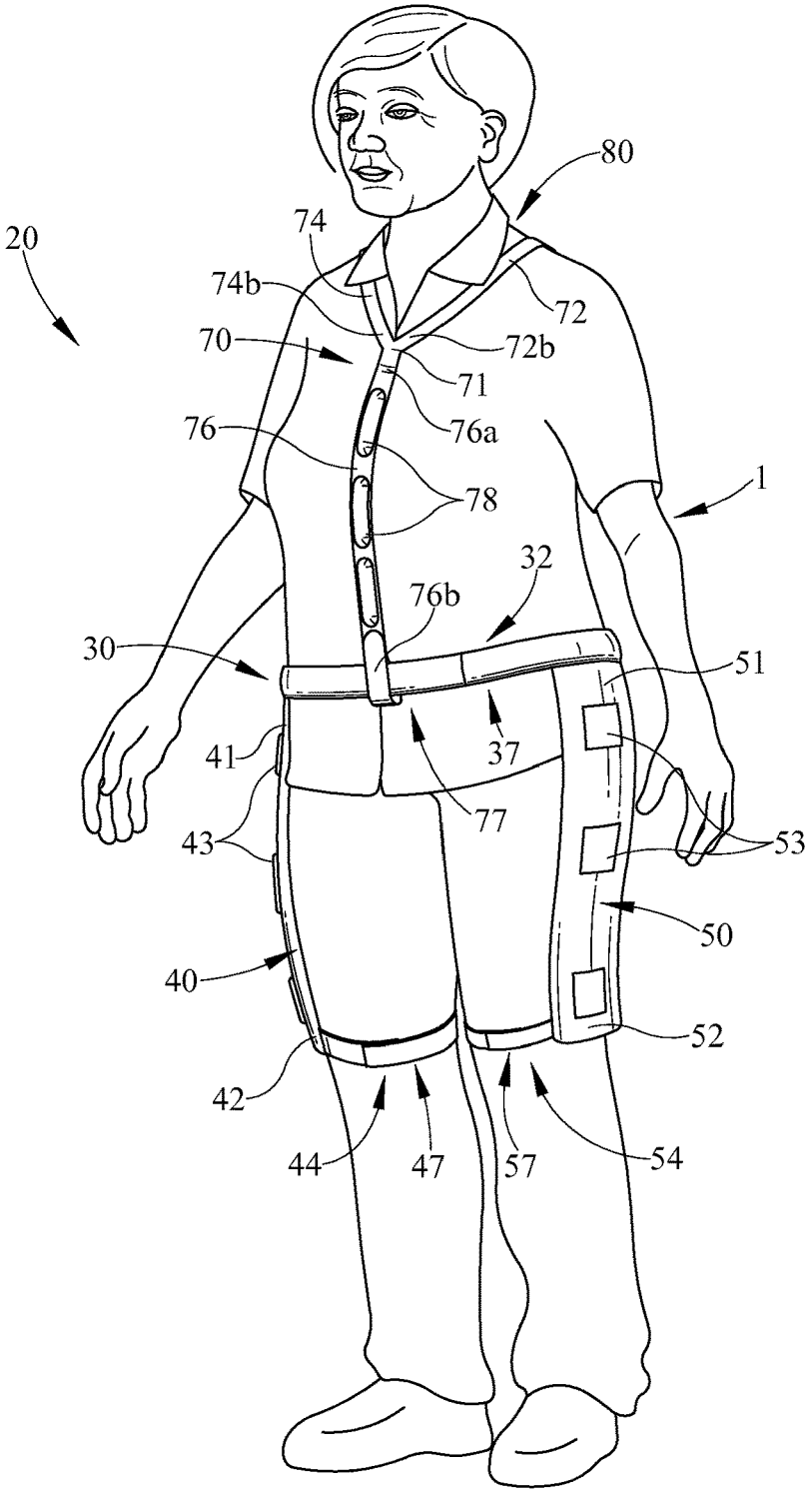
FIG. 1 is a front perspective view of an embodiment of a protective garment positioned on the human body.

It is to be understood that the embodiments are not limited in their application to the details of construction and the arrangement of components set forth in the following description or illustrated in the drawings. Other embodiments are possible and may be practiced or carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected" and "coupled" and variations thereof herein are used broadly and encompass direct and indirect connections and couplings. In addition, the terms "connected" and "coupled" and variations thereof are not restricted to physical or mechanical connections or couplings.

Figure 2:
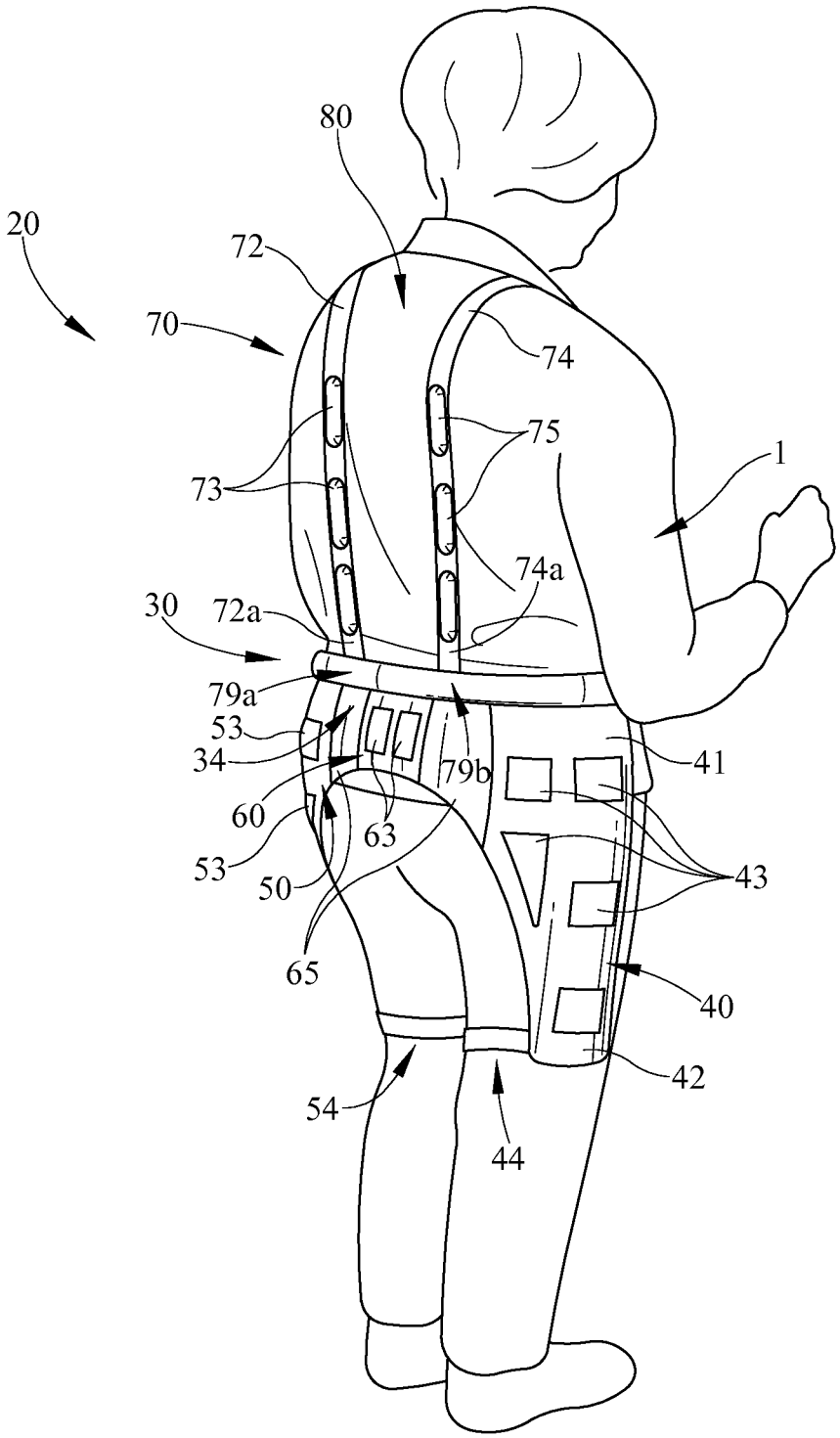
FIG. 2 is a rear perspective view of the embodiment of the protective garment of FIG. 1 positioned on the human body.
Figure 3:
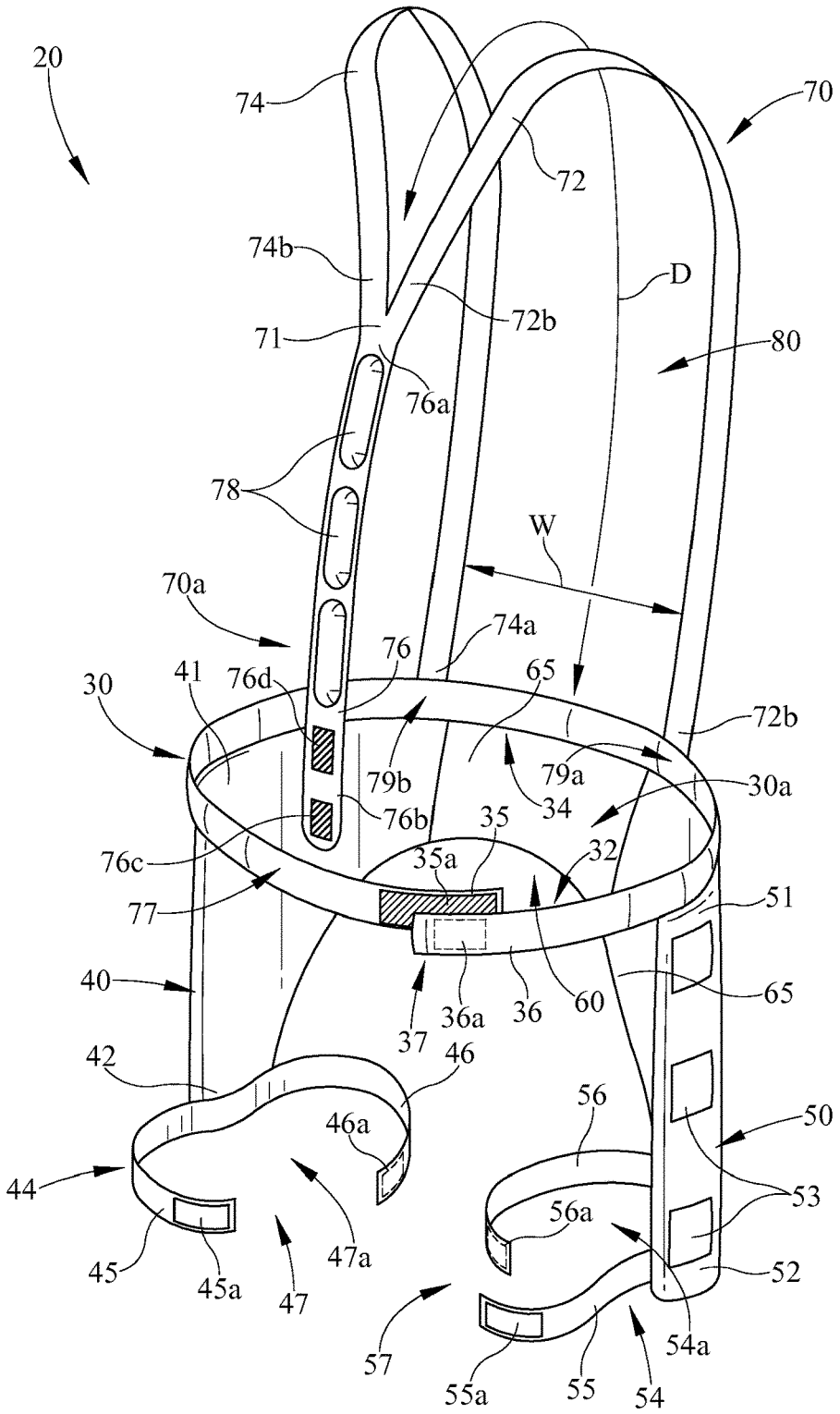
FIG. 3 is a perspective view of the embodiment of the protective garment of FIG. 1 removed from the human body, illustrating the straps releasable unsecured and capable of receiving the human body or user.

Referring to FIGS. 1-3, an embodiment of a protective garment 20 is shown as releasably secured to the human body 1 in that the garment may be removed from or secured into position. Garment 20 may be useful to, but is not limited to, elderly individuals or individuals with limited mobility, such that the wearer may position on the garment and secure to one's body with little or no help from another. Although the garment 20 is shown on the outer surface of the user's clothes, it is understood that any or all portions thereof may be hidden under one or more articles of clothing if desired. Garment 20 may protect against, but is not limited to, hip, tailbone, and/or spinal injuries.

As is shown in one embodiment of the figures, the protective garment 20 utilizes multiple straps and one or more pads to reduce injury to the human body 1 while allowing for the user, or more specifically a user with limited mobility, to place the garment 20 on with little or no assistance from others. As is shown, the waist belt 30 is releasably secured to the user's waist area via an attachment 37. The waist belt 30 may be made of elastic material to allow for user adjustment. As shown in FIGS. 1 and 3, the circular waist belt 30 may include a front side 32 and an opposing back side 34. Adjacent the front side 32, the waist belt may include a first end 35 releasably secured to a second end 36 by one or more attachments 37. Although the attachment is shown in one embodiment as a hook and loop fastener with the hooks 35*a* on the first end 35 and the loops 36*a* on the second end 36, it may be a variety of attachments such as but not limited to snaps, buckles, clips, and/or laces. Moreover, waist belt 30 may be formed in a variety of sizes, shapes, constructions, orientations, and quantities and still be within the scope of the embodiments. For example, the waist belt may include one or more padding (not shown) around its circumference.

Below or depending from the waist belt 30 may be one or more pads to protect the lower body from injury. As is shown in one embodiment, a first hip pad 40 may depend from the waist belt 30 between the front side 32 and the back side 34. The first hip pad 40 is positioned on the outer periphery of the right hip area. The first hip pad 40 may include a first end 41 adjacent the waist belt 30 and a second end 42 spaced away therefrom. The second end 42 may extend to and above the right knee in some embodiments. The first hip pad 40 may include one or more padding 43 to absorb shock or impact to the area of the body. Adjacent the second end 42 of the first hip pad 40 may be first thigh strap 44 releasably securing the second end 42 of the first hip pad 40 to the leg via attachment 47. The first thigh strap 44 may extend interiorly towards the center of the waist belt 30 or knee. As is shown in one embodiment, the first thigh strap 44 may be positioned above the right knee. The first thigh strap 44 may include a first end 45 releasably secured to a second end 46 by one or more attachments 47. Although the attachment 47 is shown in one embodiment as a hook and loop fastener with the hooks 45*a* on the first end 45 and the loops 46*a* on the second end 46, it may be a variety of attachments such as but not limited to snaps, buckles, clips, and/or laces. Moreover, first hip pad 40 and/or first thigh strap 44 may be formed in a variety of sizes, shapes, constructions, orientations, and quantities and still be within the scope of the embodiments.

As is shown in one embodiment, an opposing second hip pad 50 may depend from the waist belt 30 opposite the first hip pad 40, between the front side 32 and the back side 34. The second hip pad 50 is positioned on the outer periphery of the left hip area. The second hip pad 50 may include a first end 51 adjacent the waist belt 30 and a second end 52 spaced away therefrom. The second end 52 may extend to and above the left knee in some embodiments. The second hip pad 50 may include one or more padding 53 to absorb shock or impact to the area of the body. Adjacent the second end 52 of the second hip pad 50 may be second thigh strap 54 releasably securing the second end 52 of the second hip pad 50 to the leg via attachment 57. The second thigh strap 54 may extend interiorly towards the center of the waist belt 30 or knee. As is shown in one embodiment, the second thigh strap 54 may be positioned above the left knee. The second thigh strap 54 may include a first end 55 releasably secured to a second end 56 by one or more attachments 57. Although the attachment 57 is shown in one embodiment as a hook and loop fastener with the hooks 55*a* on the first end 55 and the loops 56*a* on the second end 56, it may be a variety of attachments such as but not limited to snaps, buckles, clips, and/or laces. Moreover, second hip pad 50 and/or second thigh strap 54 may be formed in a variety of sizes, shapes, constructions, orientations, and quantities and still be within the scope of the embodiments.

Further as shown, a tailbone pad 60 may be included. Tailbone pad 60 may depend from the back side 34 of the waist belt 30 and protect the area adjacent the tailbone of the human body 1. The tailbone pad 60 may include one or more padding 63 to absorb shock or impact to the area of the body. The tailbone pad 60, first hip pad 40, and/or the second hip pad 50 may be interconnected by one or more support members 65. As is shown in the one embodiment, support member 65 may extend from the back side 34 of the waist belt 30 and interconnect each one of the first hip pad 40, tailbone pad 60, and the second hip pad 50. The support members may be an elastic mesh or other material. Tailbone pad 60 and/or support member 65 may be a variety of sizes, shapes, constructions, orientations, and quantities and still be within the scope of the embodiments.

Above or extending upwardly from the waist belt 30 may be one or more pads to protect the upper body, or portions thereof, from injury. As shown in the embodiment, a torso strap 70 may engage the neck area of the human body 1 and be substantially aligned with the front side 32 and back side 34 of the waist belt 30 or sagittal plane. Torso strap 70 is shown in the one embodiment as being substantially Y-shaped with slot or opening 80 receiving the neck of the body. The Y-shape of the torso strap 70 may be defined by a first back strap 72, a second back strap 74, and a front strap 76. Each of the first back strap 72 and second back strap 74 may include a first end 72*a*, 74*a*, respectively, and an opposing second end 72*b*, 74*b*, respectively. The front strap 76 includes a first end 76*a* and an opposing second end 76*b*. First end 72*a* of the first back strap 72 is connected to the back side 34 of the waist belt 30 at the first back attachment 79*a* and spaced from the first end 74*a* of the second back strap 74 connected to the back side 34 of the waist belt 30 at the second back attachment 79*b*. The first back strap 72 and the second back strap 74 may extend from the back side 34 of the waist belt 30 on lateral sides of the spine at varying distances and extends upwardly towards the neck. The first back strap 72 and second back strap 74 extend upwardly from the back side 34 of the waist belt 30 and the second ends 72*b*, 74*b* converge together at the first end 76*a* of the front strap 76 to define a strap engagement or intersection 71 of straps. The strap engagement 71 of the three straps 72, 74, and 76 is positioned on the front side of the human body 1 adjacent front side of the neck or body when worn and/or attached to the wearer. The slot 80 defined between the converging first and second back straps 72 and 74 towards the front strap 76 receives the neck. The width W of the slot 80 narrows from the back side 34 towards the front strap 76 or strap engagement 71. As is shown, the first and second back straps 72 and 74 flex or contour to the back adjacent the spine and extend over the shoulders of the body and then converge to strap engagement 71 or front strap 76. The back straps 72 and 74 run adjacent the spine to reduce injury and/or increase protection. Slot 80 receives the neck of the body and may be used on a variety of user's body. When the distance from the back side 34 of the waist belt 30 over the shoulders and to the front side 32 of the waist belt 30 varies depending on the user, the neck can be positioned within slot 80 at various distances along a direction D from the strap engagement 71 between the back side 34 and strap engagement 71 to accommodate the varying body sizes when placing the garment on and when securing to the body. The slot 80 width W and distance along direction D may provide additional clearance for inserting the head into and positioning the garment. Further, the torso strap 70 may be tightened or loosened to accommodate the varying distance along the direction D the neck may be located. The torso strap 70 may be adjusted in its length, from first ends 72*a*, 74*a* of the back straps to the second end 76*b* of the front strap 76 because the front strap 76 releasably secures to the front side 32 of the waist belt 30 by one or more front attachments 77. The front attachment 77 is adjacent the attachment 37 on the waist belt 30. In the one embodiment shown, front attachment 77 may be a hook and loop fastener with the hooks 76*c* and the loops 76*d* on the second end 76*b*. In use, the second end 76*b* is looped around the waist belt 30 and overlapped upon itself to tighten and secure the torso strap 70. Although the front attachment 77 is shown it may be a variety of attachments such as but not limited to snaps, buckles, clips, and/or laces. For example the hooks and loops may be separated between two straps, such that the hooks may be on the second end 76*b* and the loops on the waist belt 30. Although shown that the first ends 72*a* and 74*a* are fixedly secured to the waist belt 30 by a first back attachment 79*a* and a second back attachment 79*b*, respectively, it is to be understood that the one or more attachments 79*a*, 79*b* may releasably secure the first and second back straps 72 and 74 to the waist belt 30. The torso strap 70 may include one or more paddings. As shown in the figures, the first back strap 72, the second back strap 74, and/or front strap 76 may include one or more paddings 73, 75, 78 to absorb shock or impact to the area of the body, respectively. The back straps with padding 73 and 75 on lateral sides of the spine may reduce spine injury and/or increase protection. If used, the padding 78 on the front strap 76 may protect the chest and/or portions thereof. Moreover, the torso strap 70 may be formed in a variety of sizes, shapes, constructions, orientations, and quantities and still be within the scope of the embodiments.

Further, although one or more paddings 43, 53, 63, 73, 75, and 78 are shown in detail in various positions and patterns in the drawings, they merely represent one embodiment, and it is to be understood that there are a variety of shapes, quantities, positions, compositions, orientations, patterns, and constructions which may be used and still be within the scope of these embodiments. For example, not all the padding has to be the same. Further although the padding may be air pockets as is shown, the padding may be a variety of one or more materials, layered, substantially rigid, foam, etc.

As is shown in FIG. 3, the garment 20 includes one more attachments releasably securing the garment to the body. Attachments 37, 47, 57, and 77 each define an opening that the human body 1 may be received when putting on the garment. Waist belt 30 defines an opening 30*a* for receiving the waist at attachment 37. First thigh strap 44 defines an opening 44*a* for receiving the right leg at attachment 47. Second thigh strap 54 defines an opening 54*a* for receiving the left leg at attachment 57. Torso strap 70 defines an opening 70*a* for receiving the upper body at front attachment 77. It is illustrated that the openings 44*a*, 54*a*, 30*a*, and 70*a* are generally at the front of the garment 20 and can receive the portions of the human body 1 with little movement by the user and subsequently secure by the attachments.

Although it is shown that one or more of the attachments 37, 47, 57, and 77 may be adjustable to accommodate varying sizes of the body for which they releasably attach or one or more of the straps 44, 54, 30, and/or 70 may include slide adjusters (not shown) to adjust the length of the strap between its ends. Further, the straps may be a variety of materials but is not limited to an elastic material.

In use, the protective garment 20 may be placed upon the human body 1 and releasably secured. In one embodiment, the user can place his/her neck into the slot 80 of the torso strap 70 with the strap engagement 71 adjacent the chin, front side of throat, and/or chest. The Y-shape of the torso strap 70 may be easily slipped over the head and neck without having to extend arms through additional openings or sleeves, such as a shirt, on the lateral sides of the body. The strap engagement 71 and/or slot 80 may also allow the garment 20 to hang adjacent to or around the neck, and/or help self-position the garment 20 relative to the human body 1 to secure the one or more attachments. With the garment 20 in general position, the user may secure the waist belt 30 about the waist, secure the first thigh strap 44 to the right leg, secure the second thigh strap 54 to the left leg, and/or secure the front strap 76 or torso strap 70 to the remainder of the waist belt 30. Upon securing the garment, the paddings 43, 53, 63, 73, 75, and/or 78 are in position to protect the intended area of the body. It should be understood, that with limited movement of the arms and hands the user may place the head through the slot 80 and secure the remaining attachments that are generally in the front of the body, adjacent to the waist and above the knee.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and embodiments have been presented for purposes of illustration. It is not intended to be exhaustive or to limit the precise steps and/or forms disclosed, and obviously many modifications and variations are possible in light of the above teaching. It is intended that the scope and all equivalents be defined by the claims appended hereto.

What is claimed is:

1. A protective garment for a human body comprising:

a waist belt adapted to releasably secure about the waist, wherein said waist belt includes a front side and a back side;

a first hip pad and an opposing second hip pad depending from said waist belt, wherein each said first hip pad and said second hip pad has a first end adjacent said waist belt and an opposing second end spaced away therefrom, and wherein each of said first hip pad and said second hip pad includes one or more padding;

said first hip pad includes a first thigh strap adjacent said second end of said first hip pad and adapted to releasably secure above the right knee;

said second hip pad includes a second thigh strap adjacent said second end of said second hip pad and adapted to releasably secure above the left knee;

a torso strap including a first back strap, a second back strap, and a front strap, wherein said front strap includes a first end and a second end, wherein said first back strap and said second back strap extend upwardly from said back side of said waist belt and converge together at said first end of said front strap to define a slot adapted to receive the neck, and wherein said second end of said front strap releasably secures to said front side of said waist belt, and wherein each of said first back strap and said second back strap includes one or more padding; and a tailbone pad having one or more padding depending downwardly from a back side of said waist belt between said first and said second hip pad.

2. The protective garment of claim 1 wherein said one or more padding is air pockets.

3. The protective garment of claim 1 wherein each of said first back strap and said second back strap is fixedly secured to said back side of said waist belt.

4. The protective garment of claim 1 wherein said slot narrows in a direction from said back side of said waist belt to said first end of said front strap.

5. The protective garment of claim 1 wherein said front strap includes a plurality of linearly oriented padding.

6. A protective garment for a human body comprising:

a waist belt adapted to releasably secure about the waist, wherein said waist belt includes a front side and a back side;

a first hip pad and an opposing second hip pad depending from said waist belt, wherein each said first hip pad and said second hip pad has a first end adjacent said waist belt and an opposing second end spaced away therefrom, and wherein each of said first hip pad and said second hip pad includes one or more padding;

a tailbone pad depending from said waist belt between said first hip pad and said second hip pad, wherein said tailbone pad having one or more padding;

said first hip pad includes a first thigh strap adjacent said second end of said first hip pad and adapted to releasably secure above the right knee;

said second hip pad includes a second thigh strap adjacent said second end of said second hip pad and adapted to releasably secure above the left knee; and a torso strap including a first back strap, a second back strap, and a front strap, wherein said front strap includes a first end and a second end, wherein said first back strap and said second back strap extend upwardly from said back side of said waist belt and converge together at said first end of said front strap to define a slot adapted to receive the neck, and wherein said second end of said front strap releasably secures to said front side of said waist belt, and wherein each of said first back strap and said second back strap includes one or more padding.

7. The protective garment of claim 6 wherein said one or more padding is air pockets.

8. The protective garment of claim 6 wherein each of said first back strap and said second back strap is fixedly secured to said back side of said waist belt.

9. The protective garment of claim 6 wherein said slot narrows in a direction from said back side of said waist belt to said first end of said front strap.

10. The protective garment of claim 6 wherein said front strap includes one or more padding.

11. A protective garment for the human body comprising:

a waist belt adapted to releasably secure about the waist, wherein said waist belt includes a front side and a back side;

a first hip pad and an opposing second hip pad depending from said waist belt, wherein each said first hip pad and said second hip pad has a first end adjacent said waist belt and an opposing second end spaced away therefrom, and wherein each of said first hip pad and said second hip pad includes one or more padding;

a tailbone pad depending from said waist belt between said first hip pad and said second hip pad, wherein said tailbone pad having one or more padding;

said first hip pad includes a first thigh strap adjacent said second end of said first hip pad and adapted to releasably secure above the right knee;

said second hip pad includes a second thigh strap adjacent said second end of said second hip pad and adapted to releasably secure above the left knee;

a torso strap including a Y-shaped strap extending from said back side of said waist belt to said front side of said waist belt, said Y-shaped strap having two back attachments on said back side of said waist belt and a front attachment on said front side of said waist belt, wherein at least said front attachment releasably secures to said front side of said waist belt; and wherein said Y-shaped strap includes one or more padding.

12. The protective garment of claim 11 wherein said one or more padding is air pockets.

13. The protective garment of claim 11 wherein said two back attachments are fixedly secured to said back side of said waist belt.

14. The protective garment of claim 11 wherein said Y-shaped strap includes two back straps converging with a front strap.

15. The protective garment of claim 14 wherein said front attachment includes said front strap looped around said waist belt and secured upon said front strap.

16. The protective garment of claim 15 wherein said front strap is secured upon said front strap by a hook and loop fastener.

17. The protective garment of claim 14 wherein said two back straps include said one or more padding.

18. The protective garment of claim 11 wherein said waist belt includes an attachment to releasably secure about the waist, and wherein said attachment of said waist belt is adjacent said front attachment.

19. The protective garment of claim 1 wherein each of said first back strap and said second back strap includes a plurality of linearly oriented padding.

20. The protective garment of claim 1, wherein each of said first and second hip pad includes a plurality of linearly oriented padding.

21. The protective garment of claim 1, wherein said waist belt is capable of being adjusted along a horizontal axis.

22. The protective garment of claim 21, wherein said waist belt includes a first end releasably secured to a second end by one or more attachments.

23. The protective garment of claim 1, wherein said front strap is capable of being adjusted along a horizontal axis, and wherein said front strap includes a first attachment portion looped around said waist belt and releasably secured to a second attachment portion.

* * * * *